US011402162B2

(12) United States Patent
Akaiwa et al.

(10) Patent No.: US 11,402,162 B2
(45) Date of Patent: Aug. 2, 2022

(54) DISTRIBUTOR AND HEAT EXCHANGER

(71) Applicant: Mitsubishi Electric Corporation, Tokyo (JP)

(72) Inventors: Ryota Akaiwa, Tokyo (JP); Shinya Higashiiue, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 134 days.

(21) Appl. No.: 16/969,237

(22) PCT Filed: Apr. 5, 2018

(86) PCT No.: PCT/JP2018/014598
§ 371 (c)(1),
(2) Date: Aug. 12, 2020

(87) PCT Pub. No.: WO2019/193713
PCT Pub. Date: Oct. 10, 2019

(65) Prior Publication Data

US 2021/0003353 A1 Jan. 7, 2021

(51) Int. Cl.
*F28F 9/02* (2006.01)

(52) U.S. Cl.
CPC ..... *F28F 9/0221* (2013.01); *F28F 9/0263* (2013.01); *F28F 9/0278* (2013.01); *F28F 2009/0297* (2013.01)

(58) Field of Classification Search
CPC ..... F28F 2009/0297; F28F 9/0263; F28F 9/0278; F28F 9/0221
See application file for complete search history.

(56) References Cited

U.S. PATENT DOCUMENTS

2013/0175013 A1* 7/2013 Yoshioka ..... B23K 1/0012 165/165
2015/0059401 A1 3/2015 Matsuda et al.
(Continued)

FOREIGN PATENT DOCUMENTS

EP 2998678 A1 3/2016
EP 2998681 A1 3/2016
(Continued)

OTHER PUBLICATIONS

International Search Report of the International Searching Authority dated Jun. 26, 2018 for the corresponding international application No. PCT/JP2018/014598 (and English translation).
(Continued)

*Primary Examiner* — Paul Alvare
(74) *Attorney, Agent, or Firm* — Posz Law Group, PLC

(57) ABSTRACT

A distributor and a heat exchanger each include a first plate, a second plate, and a third plate. The first plate is stacked on the second plate in a stacking direction. The second plate is stacked on the third plate in the stacking direction. The first plate has a first through hole. The second plate has a first hollow portion communicating with the first through hole, a plurality of second hollow portions communicating with the first hollow portion, and a plurality of third hollow portions each communicating with one of the plurality of second hollow portions. The third plate has a plurality of second through holes each communicating with one of the plurality of third hollow portions. A first dimension L1 that is the width of the first hollow portion is larger than a second dimension L2 that is the width of each of the plurality of second hollow portions.

11 Claims, 6 Drawing Sheets

(56) References Cited

U.S. PATENT DOCUMENTS

| | | | | |
|---|---|---|---|---|
| 2015/0345843 | A1 | 12/2015 | Voorhis et al. | |
| 2017/0211886 | A1 * | 7/2017 | Morimura | F28F 9/0204 |
| 2020/0025428 | A1 * | 1/2020 | Inoue | F28D 1/024 |

FOREIGN PATENT DOCUMENTS

| | | | | | |
|---|---|---|---|---|---|
| JP | 09189463 | A | * | 7/1997 | F28F 9/0278 |
| JP | H09-189463 | A | | 7/1997 | |
| JP | H10-132423 | A | | 5/1998 | |
| JP | H10267468 | A | * | 10/1998 | |
| JP | 2012-093075 | A | | 5/2012 | |
| JP | 2013-002688 | A | | 1/2013 | |
| JP | 2013139917 | A | * | 7/2013 | |
| JP | 2013249993 | A | * | 12/2013 | |
| JP | 2014052135 | A | * | 3/2014 | |
| JP | 2015-200497 | A | | 11/2015 | |
| JP | 2015-203506 | A | | 11/2015 | |
| JP | 2017-133820 | A | | 8/2017 | |
| WO | WO-2012043565 | A1 | * | 4/2012 | B23K 1/0012 |
| WO | WO-2013015186 | A1 | * | 1/2013 | F28D 7/0033 |

OTHER PUBLICATIONS

Office Action dated May 11, 2021, issued in corresponding JP Patent Application No. 2020-512183 (and English Machine Translation).

Extended European Search Report dated Feb. 9, 2021, issued in corresponding European Patent Application No. 18913977.7.

Office Action dated Jun. 30, 2021, issued in corresponding CN Patent Application No. 201880090402.1 (and English Machine Translation).

* cited by examiner

DISTRIBUTOR AND HEAT EXCHANGER

CROSS REFERENCE TO RELATED APPLICATION

This application is a U.S. national stage application of PCT/JP2018/014598 filed on Apr. 5, 2018, the contents of which are incorporated herein by reference.

TECHNICAL FIELD

The present invention relates to a distributor and a heat exchanger that are used in, for example, a heat circuit.

BACKGROUND ART

Distributors to distribute a fluid to heat transfer tubes of a heat exchanger are known in the art. Some of such distributors have an outer casing and an inner casing, or a double-casing structure. In such a distributor, two-phase gas-liquid refrigerant, which is a mixture of gas refrigerant and liquid refrigerant, flows into the inner casing, passes through small-diameter holes arranged in the inner casing, and flows into the outer casing. The outer casing is connected to a plurality of flat heat transfer tubes (hereinafter, "flat tubes") arranged at regular intervals. The two-phase gas-liquid refrigerant leaving the holes in the inner casing spreads in the outer casing, so that the two-phase gas-liquid refrigerant is evenly distributed to the flat tubes.

CITATION LIST

Patent Literature

Patent Literature 1: Japanese Unexamined Patent Application Publication No. 2015-203506

SUMMARY OF INVENTION

Technical Problem

For processing to fabricate the above-described distributor, it is extremely difficult to join the outer casing and the inner casing together. Forming holes having a diameter sufficient to fit the flat tube in the outer casing increases the internal volume of the distributor, resulting in an increase in amount of refrigerant held in the distributor.

Furthermore, if lubricating oil in a refrigeration cycle is immiscible, the lubricating oil will accumulate in the outer casing having a large internal volume because the lubricating oil cannot oppose gravity. The accumulation of the lubricating oil results in a reduction in amount of the lubricating oil in a compressor, causing a failure of the compressor. In addition, the accumulation of the lubricating oil causes uneven distribution of the refrigerant to the heat transfer tubes.

The present invention has been made in consideration of the above-described disadvantages, and aims to provide a distributor that has a simple structure easy to process and a small internal volume, that makes it difficult for lubricating oil to accumulate in the distributor, and that enables even distribution of refrigerant to heat transfer tubes, and to provide a heat exchanger including the distributor.

Solution to Problem

A distributor according to an embodiment of the present invention includes a first plate, a second plate, and a third plate. The first plate is stacked on the second plate in a stacking direction. The second plate is stacked on the third plate in the stacking direction. The first plate has a first through hole. The second plate has a first hollow portion communicating with the first through hole, a plurality of second hollow portions communicating with the first hollow portion, and a plurality of third hollow portions each communicating with its associated one of the plurality of second hollow portions. The third plate has a plurality of second through holes each communicating with its associated one of the plurality of third hollow portions. The first hollow portion has an elongate shape having a length along which a fluid flows and a width orthogonal to the length in a plane perpendicular to the stacking direction. The plurality of second hollow portions each have an elongate shape having a length along which the fluid flows and a width orthogonal to the length in the plane perpendicular to the stacking direction. The distributor is configured such that L1 is larger than L2 where L1 is a first dimension that is the width of the first hollow portion and L2 is a second dimension that is the width of each of the plurality of second hollow portions.

A heat exchanger according to another embodiment of the present invention includes the above-described distributor.

Advantageous Effects of Invention

In each of the distributor and the heat exchanger according to the embodiments of the present invention, the first plate is stacked on the second plate, and the second plate is stacked on the third plate. The first dimension L1, which is the width of the first hollow portion, is larger than the second dimension L2, which is the width of each of the plurality of second hollow portions. Such a configuration allows the distributor to have a simple structure easy to process and a small internal volume, make it difficult for lubricating oil to accumulate in the distributor, and enable even distribution of refrigerant to heat transfer tubes. A distributor having such a configuration and a heat exchanger including the distributor can be provided.

DESCRIPTION OF EMBODIMENTS

Figure 1:
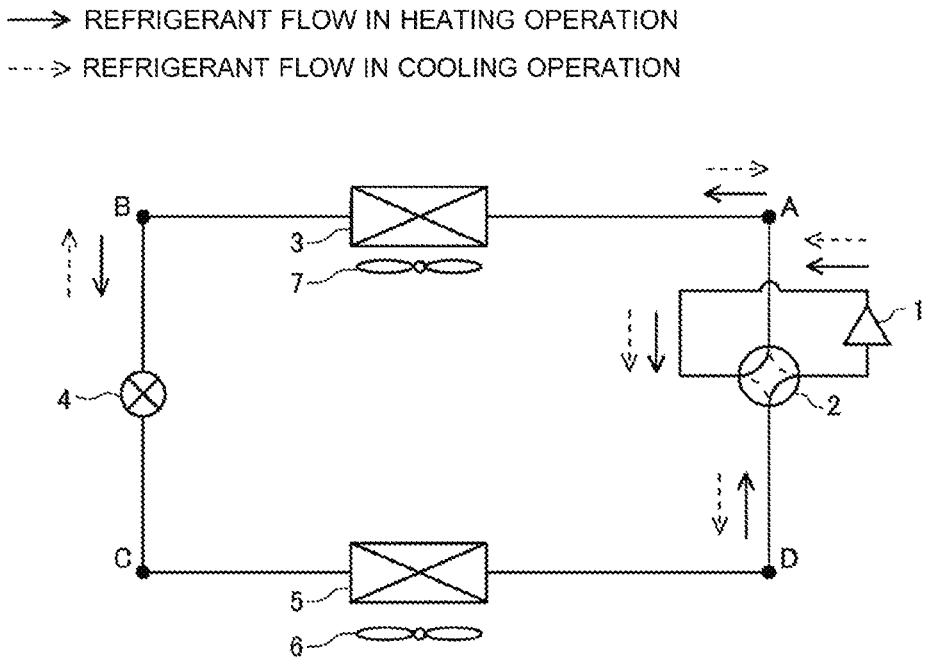
FIG. 1 is a refrigerant circuit diagram illustrating the configuration of a refrigeration cycle apparatus in Embodiment 1.

Embodiments of the present invention will be described below with reference to the drawings. Note that components designated by the same reference signs in the following figures including FIG. 1 are the same components or equivalents. This note applies throughout the description of the embodiments described below. Furthermore, note that the forms of the components described herein are intended to be illustrative only and are not intended to be limited to those described herein.

Although the embodiments will be described assuming that a distributor is used in a refrigeration cycle apparatus, the distributor may be used in any other refrigerant cycle circuit. In the following description, a heat medium used is refrigerant that changes in phase. A fluid that does not change in phase may be used as a heat medium.

Embodiment 1

A distributor according to Embodiment 1 will be described.

<Configuration of Refrigeration Cycle Apparatus>

FIG. 1 is a refrigerant circuit diagram illustrating the configuration of a refrigeration cycle apparatus in Embodiment 1.

A refrigeration cycle apparatus including one outdoor heat exchanger and one indoor heat exchanger, such as a room air conditioner for home use or a packaged air conditioner for a store or an office, will be described below as an example.

The refrigeration cycle apparatus includes a compressor 1, a four-way valve 2, an indoor heat exchanger 3, an expansion valve 4, and an outdoor heat exchanger 5, which are connected by refrigerant pipes.

An outdoor fan 6 that promotes heat exchange between the refrigerant and air is disposed next to the outdoor heat exchanger 5.

An indoor fan 7 that similarly promotes heat exchange between the refrigerant and the air is disposed next to the indoor heat exchanger 3.

A flow of the refrigerant circulated through the refrigeration cycle apparatus in FIG. 1 in a heating operation will now be described as an example.

High temperature, high pressure gas refrigerant compressed in the compressor 1 passes through the four-way valve 2 and reaches a point A.

The gas refrigerant leaving the point A is condensed in the indoor heat exchanger 3 while being cooled by the air supplied from the indoor fan 7 and then reaches a point B.

The condensed or liquid refrigerant passes through the expansion valve 4 and thus turns into low temperature, low pressure two-phase refrigerant, which is a mixture of gas refrigerant and liquid refrigerant. Then, the refrigerant reaches a point C.

After that, the two-phase refrigerant leaving the point C is evaporated in the outdoor heat exchanger 5 while being heated by the air supplied from the outdoor fan 6 and then reaches a point D.

The gas refrigerant leaving the point passes through the four-way valve 2 and then returns to the compressor 1.

This cycle causes the heating operation for heating indoor air.

In a cooling operation, the four-way valve 2 is switched to reverse the above-described flow.

Specifically, the high temperature, high pressure gas refrigerant compressed in the compressor 1 passes through the four-way valve 2 and then flows to the point D. The refrigerant passes through the outdoor heat exchanger 5, the expansion valve 4, and the indoor heat exchanger 3 and then reaches the point A. The refrigerant passes through the four-way valve 2 and then returns to the compressor 1. This cycle causes the cooling operation for cooling the indoor air.

<Configuration of Heat Exchanger>

The configuration of a heat exchanger 100 in Embodiment 1 will now be described.

Although an example in which the heat exchanger 100 is used as the outdoor heat exchanger 5 will be described in Embodiment 1, the heat exchanger 100 can be used as the indoor heat exchanger 3.

Figure 2:
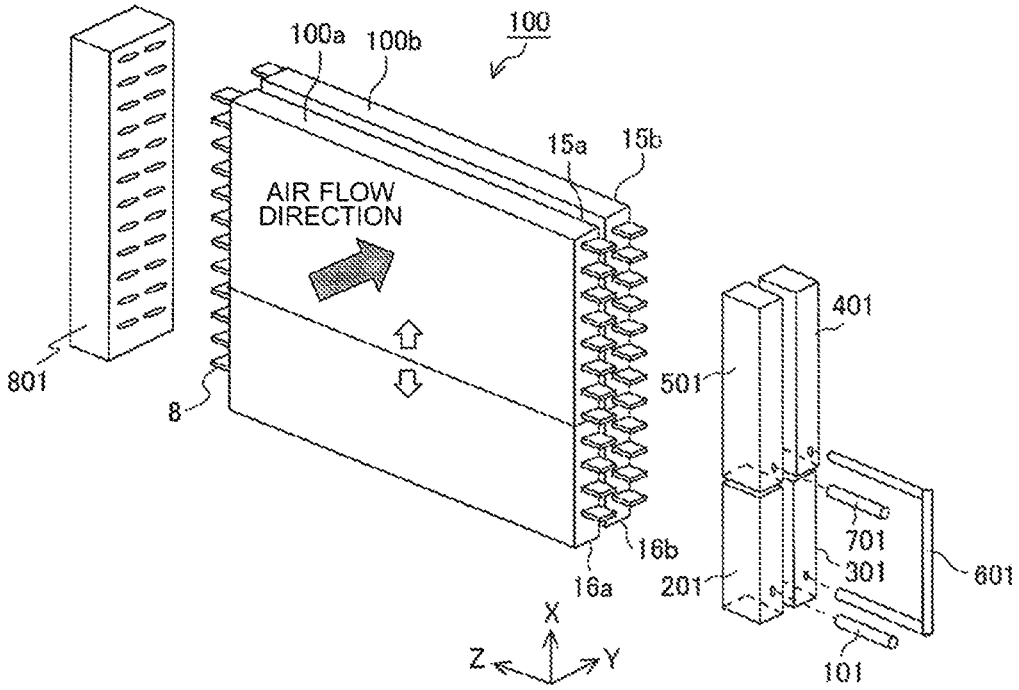
FIG. 2 is an exploded perspective view illustrating the configuration of a heat exchanger 100 in Embodiment 1.

FIG. 2 is an exploded perspective view illustrating the configuration of the heat exchanger 100 in Embodiment 1.

As used herein, the term "Y-axis direction" refers to a direction in which the air passes through the heat exchanger 100, the term "Z-axis direction" refers to a direction along the length of a heat transfer tube 8 included in the heat exchanger 100, and the term "X-axis direction" refers to a vertically upward direction in the heat exchanger 100.

The heat exchanger 100 includes two heat exchanger elements arranged in the Y-axis direction. The heat exchanger 100 includes an upstream heat exchanger element 100*a* defining an upwind side of the heat exchanger and a downstream heat exchanger element 100*b*.

The upstream heat exchanger element 100*a* has two sections arranged in the X-axis direction, namely, a primary heat exchange section 15*a* and a secondary heat exchange section 16*a*.

The downstream heat exchanger element 100*b* has two sections arranged in the X-axis direction, namely, a primary heat exchange section 15*b* and a secondary heat exchange section 16*b*.

For the heat transfer tube 8 through which the refrigerant flows, a flat tube is used.

For example, eight heat transfer tubes 8 are arranged in each of the primary heat exchange sections 15*a* and 15*b*, and four heat transfer tubes 8 are arranged in each of the secondary heat exchange sections 16*a* and 16*b*.

The shape of each heat transfer tube, the number of heat transfer tubes arranged vertically, and the number of heat transfer tubes arranged horizontally in the heat exchanger 100 are intended to be illustrative only and are not intended to be limited to those described herein.

Peripheral parts for the heat exchanger 100 will now be described.

A secondary heat exchange distributor 201 is attached to the secondary heat exchange section 16*a* of the upstream heat exchanger element 100*a*. An inlet pipe 101 is attached to the secondary heat exchange distributor 201.

A primary heat exchange distributor 501 is attached to the primary heat exchange section 15*a* of the upstream heat exchanger element 100*a*. An outlet pipe 701 is attached to the primary heat exchange distributor 501.

A secondary heat exchange distributor 301 is attached to the secondary heat exchange section 16*a* of the downstream heat exchanger element 100*b*.

A primary heat exchange distributor 401 is attached to the primary heat exchange section 15*a* of the downstream heat exchanger element 100*b*. The secondary heat exchange distributor 301 and the primary heat exchange distributor 401 are connected by a connecting pipe 601.

The upstream heat exchanger element 100*a* and the downstream heat exchanger element 100*b* are connected by a connecting header 801.

A flow of the refrigerant in the heating operation of the refrigeration cycle apparatus of FIG. 1 in which the heat exchanger 100 in Embodiment 1 is used as the outdoor heat exchanger 5 will now be described with reference to FIGS. 2 and 3.

Specifically, the heat exchanger 100 functions as an evaporator.

Figure 3:
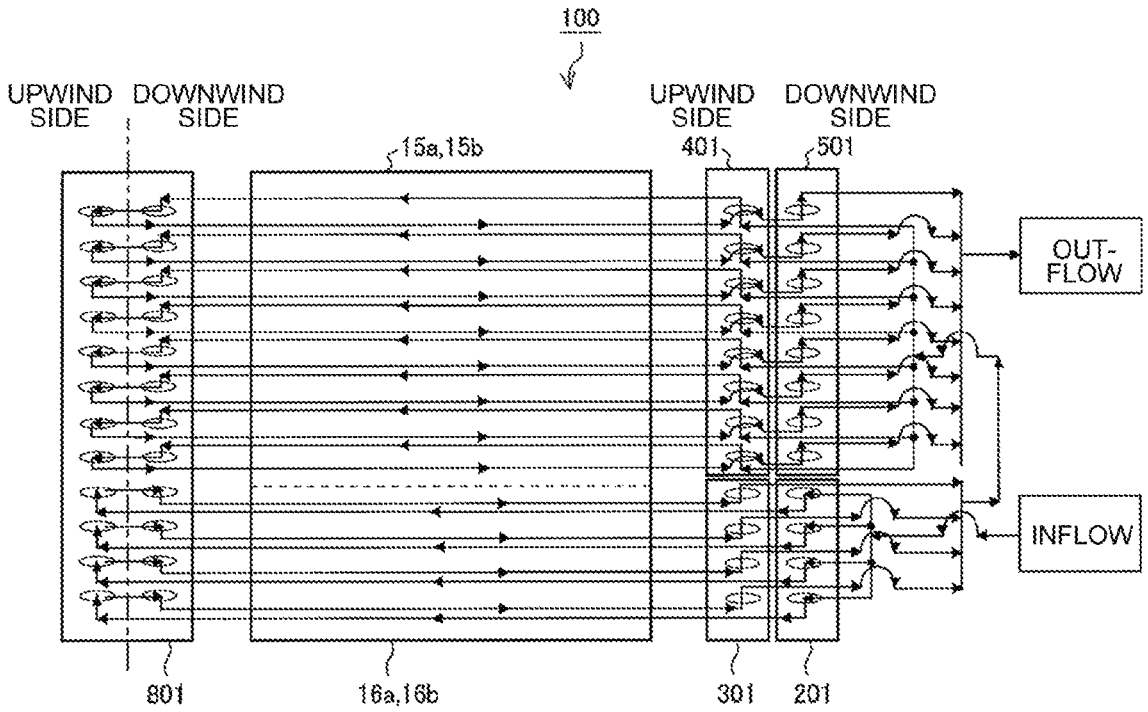
FIG. 3 is a schematic diagram illustrating a flow of refrigerant in the heat exchanger 100 in Embodiment 1.

FIG. 3 is a schematic diagram illustrating the flow of the refrigerant in the heat exchanger 100 in Embodiment 1.

Liquid refrigerant flows into the secondary heat exchange distributor 201 through the inlet pipe 101. The liquid refrigerant is divided into refrigerant streams in the secondary heat exchange distributor 201. The refrigerant streams flow into the heat transfer tubes 8 in the secondary heat exchange section 16*a* of the upstream heat exchanger element 100*a*. The refrigerant streams leaving these heat transfer tubes 8 flow into the connecting header 801, turn, and flow into the heat transfer tubes 8 in the secondary heat exchange section 16*a* of the downstream heat exchanger element 100*b*.

The refrigerant streams leaving the secondary heat exchange section 16*a* of the downstream heat exchanger element 100*b* flow into the secondary heat exchange distributor 301 and join together. Then, the refrigerant flows into the primary heat exchange distributor 401 through the connecting pipe 601. The refrigerant is divided into refrigerant streams in the primary heat exchange distributor 401. The refrigerant streams flow into the heat transfer tubes 8 in the primary heat exchange section 15*b* of the downstream heat exchanger element 100*b*. The refrigerant streams leaving these heat transfer tubes 8 flow into the connecting header 801, turn, and flow into the heat transfer tubes 8 in the primary heat exchange section 15*a* of the upstream heat exchanger element 100*a*. The refrigerant streams leaving these heat transfer tubes 8 flow into the primary heat exchange distributor 501 and join together. Then, the refrigerant flows out of the primary heat exchange distributor 501 through the outlet pipe 701.

<Configuration of Distributor>

An internal structure of a distributor 10 according to Embodiment 1 will now be described.

Figure 4:
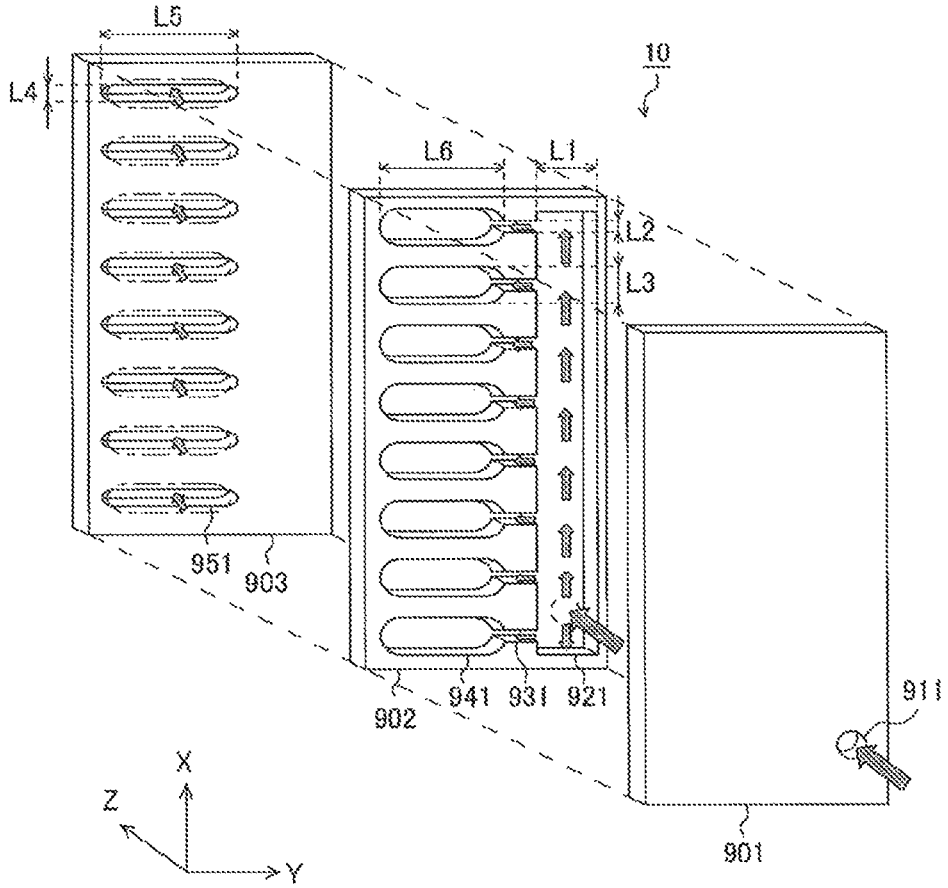
FIG. 4 is an exploded perspective view illustrating components of a distributor 10 according to Embodiment 1.

FIG. 4 is an exploded perspective view illustrating components of the distributor 10 according to Embodiment 1.

It is assumed in FIG. 4 that the distributor 10 is, for example, the primary heat exchange distributor 401. FIG. 4 illustrates the distributor 10 to distribute the refrigerant to the eight heat transfer tubes 8. The distributor 10 may be used in any other position and may distribute the refrigerant to any number of heat transfer tubes.

Figure 5:
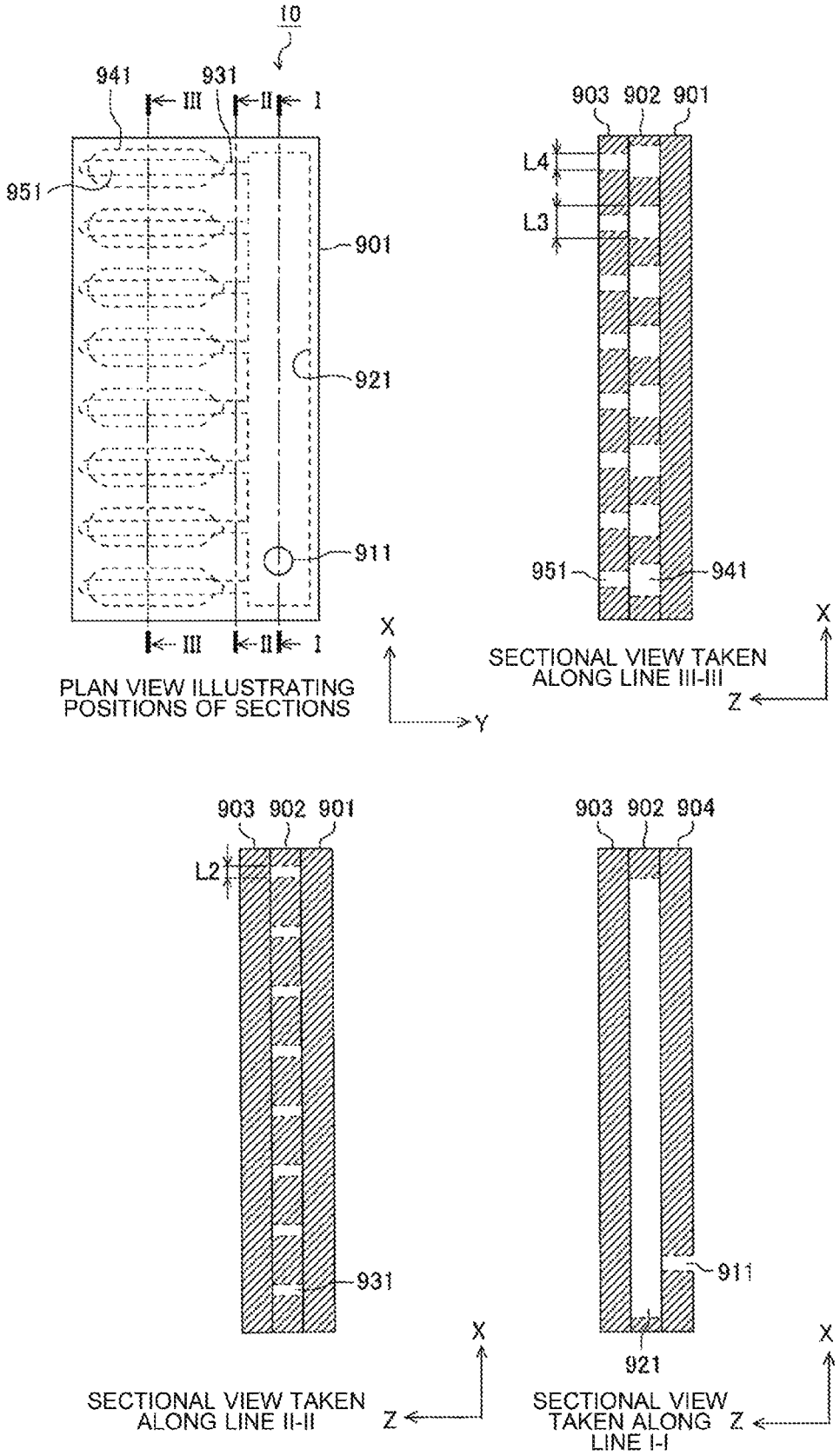
FIG. 5 includes sectional views of the distributor 10 according to Embodiment 1 orthogonal to a Y-axis direction.

FIG. 5 includes sectional views of the distributor 10 according to Embodiment 1 orthogonal to the Y-axis direction.

FIG. 5 includes a plan view of the distributor 10, and illustrates three sections of the distributor 10 taken in the Z-axis direction.

A sectional view taken along line I-I corresponds to a section including a first through hole 911 of a first plate 901 and a first hollow portion 921 of a second plate 902.

A sectional view taken along line II-II corresponds to a section including second hollow portions 931 of the second plate 902.

A sectional view taken along line III-III corresponds to a section including third hollow portions 941 of the second plate 902 and second through holes 951 of a third plate 903.

The distributor 10 includes the first plate 901, the second plate 902, and the third plate 903 such that the first plate 901 is stacked on the second plate 902 in a stacking direction and the second plate 902 is stacked on the third plate 903 in the stacking direction, which is the Z-axis direction. For the first plate 901, the second plate 902, and the third plate 903, plate materials made of a relatively low cost, lightweight material, such as aluminum, and having a thickness of approximately 0.5 to approximately 0.7 mm are used. The plate materials are stamped to form openings. Then, the plate materials are stacked on one another and joined together by brazing. At this time, a brazing sheet, such as an aluminum-based plate containing a brazing material, can be used as the second plate 902 to be interposed between the first plate 901 and the third plate 903, thereby joining the first plate 901, the second plate 902, and the third plate 903 together. Such a manufacturing process, which is short-time minimal processing, enables fabrication of the distributor 10 having a small internal volume.

The first plate 901 has the first through hole 911 connected to the connecting pipe 601, serving as an inlet pipe.

The second plate 902 has the first hollow portion 921 having an elongate shape having a length in the X-axis direction in a plane perpendicular to the stacking direction, the second hollow portions 931 each having an elongate shape having a length in the Y-axis direction in the plane perpendicular to the stacking direction, and the third hollow portions 941 each having an elongate shape having a length in the Y-axis direction in the plane perpendicular to the stacking direction. The second hollow portions 931 correspond one-to-one to the third hollow portions 941, and connect the first hollow portion 921 to the third hollow portions 941. In other words, the first hollow portion 921, the second hollow portions 931, and the third hollow portions 941 communicate with each other. Each of the first hollow portion 921, the second hollow portions 931, and the third hollow portions 941 may have a rectangular shape or have arcuate ends in the plane perpendicular to the stacking direction.

The first hollow portion 921 of the second plate 902 agrees with the first through hole 911 of the first plate 901.

The third plate 903 has the second through holes 951 arranged in one-to-one correspondence to the third hollow portions 941 of the second plate 902. The second through holes 951 each have an elongate shape having a length in the Y-axis direction. Each of the second through holes 951 may have a rectangular shape or have arcuate ends in the plane perpendicular to the stacking direction. Each of the second through holes 951 agrees with the corresponding one of the third hollow portions 941 of the second plate 902. In other words, the second through holes 951 correspond one-to-one to the third hollow portions 941.

The first hollow portion 921 has a first dimension L1 in the Y-axis direction, or its width. Each of the second hollow portions 931 has a second dimension L2 in the X-axis direction, or its width. The first dimension L1 is larger than the second dimension L2. Furthermore, each of the third hollow portions 941 has a third dimension L3 in the X-axis direction, or its width. The third dimension L3 is larger than the second dimension L2 and is smaller than the first dimension L1.

The above-described relationship between the first dimension L1, the second dimension L2, and the third dimension L3 enables the refrigerant held in the first hollow portion 921 to be evenly distributed to the third hollow portions 941 through the second hollow portions 931 each functioning to reduce the flow rate of the refrigerant.

Each of the second through holes 951 has a fourth dimension L4 in the X-axis direction, or its width. The fourth dimension L4 is smaller than the third dimension L3, which is the width of each third hollow portion 941, in the X-axis direction. The second through hole 951 has a fifth dimension L5 in the Y-axis direction, or its length. Each of the third hollow portions 941 has a sixth dimension L6 in the Y-axis direction, or its length. The fifth dimension L5 is larger than the sixth dimension L6.

The flat tubes, or the heat transfer tubes 8, are inserted into the second through holes 951 of the third plate 903. At this time, the above-described relationship between the third dimension L3, the fourth dimension L4, the fifth dimension L5, and the sixth dimension L6 causes an end of each of the heat transfer tubes 8 to come into contact with parts of a surface of the second plate 902 adjacent to the third plate 903 and the parts are next to opposite ends of the corresponding one of the third hollow portions 941 in the Y-axis direction. Thus, the end of the heat transfer tube 8 is not inserted into the third hollow portion 941.

To achieve the above-described effect, the third dimension L3 in the X-axis direction of each of the third hollow portions 941 of the second plate 902 may be set smaller than the fourth dimension L4 in the X-axis direction of each of the second through holes 951 of the third plate 903. In this case, the end of each heat transfer tube 8 is in contact with parts of the surface of the second plate 902 adjacent to the third plate 903 and the parts are next to opposite sides of the corresponding one of the third hollow portions 941 in the X-axis direction.

The first hollow portion 921, the second hollow portions 931, and the third hollow portions 941 do not necessarily have to completely extend through the second plate 902. For example, as long as the first hollow portion 921 and the second hollow portions 931 satisfy the above-described relationship between the first dimension L1 and the second dimension L2, openings of the first hollow portion 921 and the second hollow portions 931 adjacent to the third plate 903 may be closed. In this case, the dimensions of the first hollow portion 921 and the second hollow portions 931 in the Z-axis direction are smaller than the thickness of the second plate 902.

As long as the third hollow portions 941 each have the third dimension L3 and the sixth dimension L6 satisfying the above-described relationship and each have at least one aperture communicating with the corresponding one of the second through holes 951, an opening of each of the third hollow portions 941 adjacent to the third plate 903 may be partially closed.

The flow of the refrigerant in the distributor 10 in the operation in which the heat exchanger 100 functions as an evaporator will now be described. It is assumed herein that the distributor 10 is used as the primary heat exchange distributor 401.

As illustrated in FIG. 4, the first plate 901 has the first through hole 911 through which the refrigerant enters.

The refrigerant passes through the first through hole 911 and flows into the first hollow portion 921 of the second plate 902.

The flowing refrigerant spreads in the X-axis direction corresponding to the longitudinal direction of the first hollow portion 921. The refrigerant is then distributed to the second hollow portions 931.

In this configuration, the width of each of the second hollow portions 931 in the X-axis direction, along which the shorter axis of the second hollow portion 931 extends, is smaller than the width of the first hollow portion 921 in the Y-axis direction, along which the shorter axis of the first hollow portion 921 extends. This relationship causes the refrigerant flowing into the first hollow portion 921 to spread within the first hollow portion 921 where the refrigerant can hardly experience pressure loss. The refrigerant spreading in the first hollow portion 921 is pressed by following refrigerant supplied through the first through hole 911, so that the refrigerant is evenly distributed to the second hollow portions 931, each serving as a narrow passage, while the spread of the refrigerant is being kept in the first hollow portion 921.

The refrigerant then passes through each second hollow portion 931, accumulates in the corresponding one of the third hollow portions 941, and then flows into the corresponding one of the second through holes 951 arranged in the third plate 903. The refrigerant then flows into the corresponding one of the heat transfer tubes 8 fitted in the second through holes 951.

<Advantageous Effects>

As described above, the distributor 10 according to Embodiment 1 includes the three plates that provide a simple structure and a small internal volume. In addition, the refrigerant held in the first hollow portion 921 is distributed through the second hollow portions 931 each functioning to reduce the flow rate of the refrigerant. Such a configuration reduces accumulation of lubricating oil and allows the refrigerant to be evenly distributed to the heat transfer tubes 8.

Embodiment 2

A distributor 11 according to Embodiment 2 will be described.

In Embodiment 2, the elements common to Embodiment 1 are designated by the same reference signs and a description of these elements is omitted. The following description will focus on the difference between Embodiment 2 and Embodiment 1.

The distributor 11 according to Embodiment 2 is used in the refrigeration cycle apparatus and the heat exchanger 100, which are the same as those in Embodiment 1.

The distributor 11 according to Embodiment 2 differs from the distributor 10 according to Embodiment 1 in the shape of the second plate 902.

<Configuration of Distributor>

Figure 6:
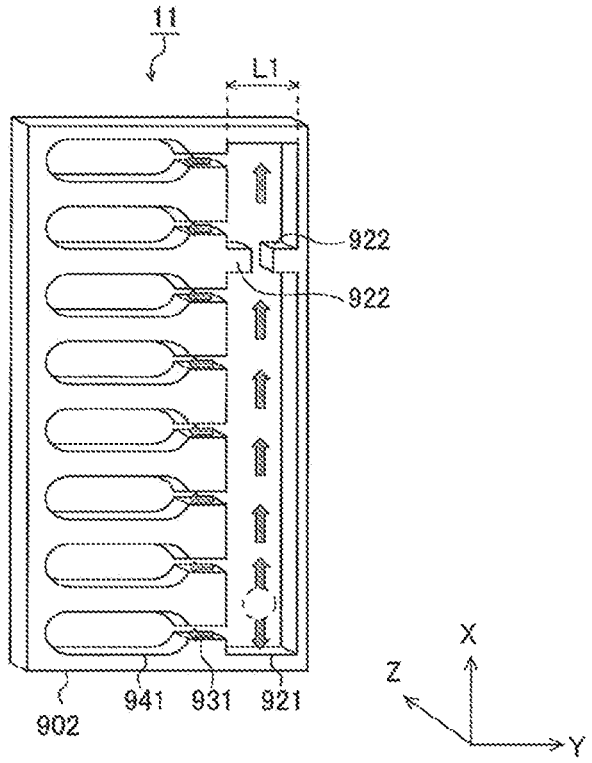
FIG. 6 is a perspective view of a second plate 902 of a distributor 11 according to Embodiment 2.

FIG. 6 is a perspective view of the second plate 902 of the distributor 11 according to Embodiment 2.

The first hollow portion 921 of the second plate 902 includes protrusions 922 to partly reduce the passage width corresponding to the first dimension L1, which is the width of the first hollow portion 921, in the Y-axis direction. One pair of protrusions 922 protrude from internal side walls of the first hollow portion 921. For example, as illustrated in FIG. 6, the protrusions 922 can be arranged such that two third hollow portions 941 are located downstream of the protrusions 922 in a refrigerant flow direction in the first hollow portion 921.

<Advantageous Effects>

The pair of protrusions 922 reduce the flow rate of the refrigerant flowing to a region downstream of the protrusions 922 in the first hollow portion 921. Consequently, the third hollow portions 941 located downstream of the protrusions 922 receive a smaller amount of refrigerant than the third hollow portions 941 located upstream of the protrusions 922. This results in uneven distribution of the refrigerant to the heat transfer tubes 8.

Such a form of the first hollow portion 921 is effective in distributing the refrigerant on the basis of an uneven flow rate distribution of air supplied to the heat exchanger 100. For example, the heat transfer tubes 8 connected to the region downstream of the protrusions 922 are used as heat transfer tubes 8 arranged in a section where the air flow rate is low. As described above, the protrusions 922 can be used to maximize the performance of the heat exchanger 100.

<Modification 1>

A modification of the distributor 11 according to Embodiment 2 will be described.

Figure 7:
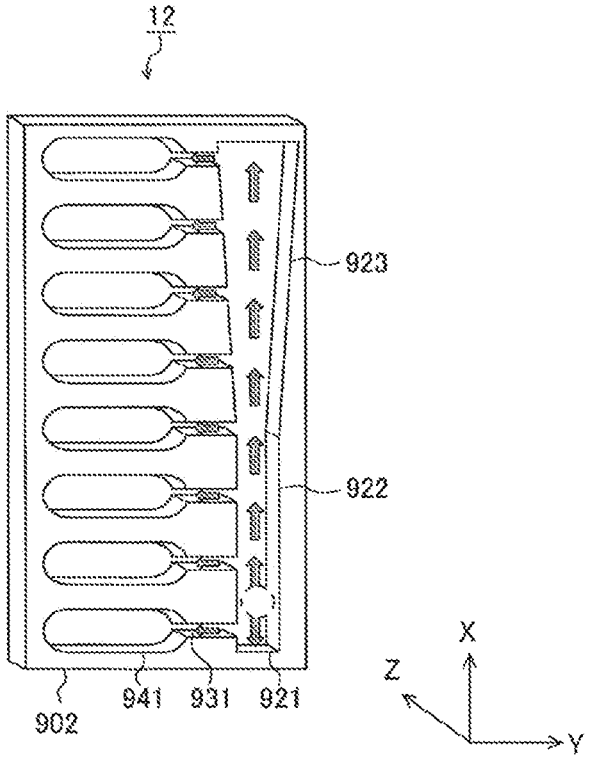
FIG. 7 is a perspective view of a second plate 902 of a distributor 12, which is a modification of the distributor 11 according to Embodiment 2.

FIG. 7 is a perspective view of the second plate 902 of a distributor 12, which is a modification of the distributor 11 according to Embodiment 2.

The first hollow portion 921 of the second plate 902 includes a broadening part 923 in which the first dimension L1 in the Y-axis direction, or the width, gradually increases toward a downstream end of the first hollow portion 921 in the refrigerant flow direction and a parallel-sided part 924 in which the first dimension L1, or the width, remains unchanged.

The broadening part 923 extends continuously from the parallel-sided part 924.

The position of the boundary between the broadening part 923 and the parallel-sided part 924 can be appropriately changed based on the characteristics of the heat exchanger 100.

<Advantageous Effects>

The distributor 12 according to Modification of Embodiment 2 is configured such that the broadening part 923 is located in a downstream region of the first hollow portion 921. In such a configuration, the third hollow portions 941 located in the downstream region receive a larger amount of refrigerant than the third hollow portions 941 located in an upstream region. Consequently, the amount of refrigerant flowing from the third hollow portions 941 communicating with the broadening part 923 into the heat transfer tubes 8 is larger than the amount of refrigerant flowing from the third hollow portions 941 communicating with the parallel-sided part 924 into the heat transfer tubes 8.

Such a shape of the first hollow portion 921 enables refrigerant distribution based on an uneven flow rate distribution of air supplied to the heat exchanger 100. For example, the heat transfer tubes 8 arranged in a section where the air flow rate is high are connected to correspond to the broadening part 923. As described above, the broadening part 923 can be used to adjust the amounts of refrigerant to be distributed to the heat transfer tubes, thus maximizing the performance of the heat exchanger 100.

Embodiment 3

A distributor 13 according to Embodiment 3 will be described.

In Embodiment 3, the elements common to Embodiment 1 are designated by the same reference signs and a description of these elements is omitted. The following description will focus on the difference between Embodiment 3 and Embodiment 1.

The distributor 13 according to Embodiment 3 is used in the refrigeration cycle apparatus and the heat exchanger 100, which are the same as those in Embodiment 1.

The distributor 13 according to Embodiment 3 differs from the distributor 10 according to Embodiment 1 in the shape of the second plate 902.

<Configuration of Distributor>

Figure 8:
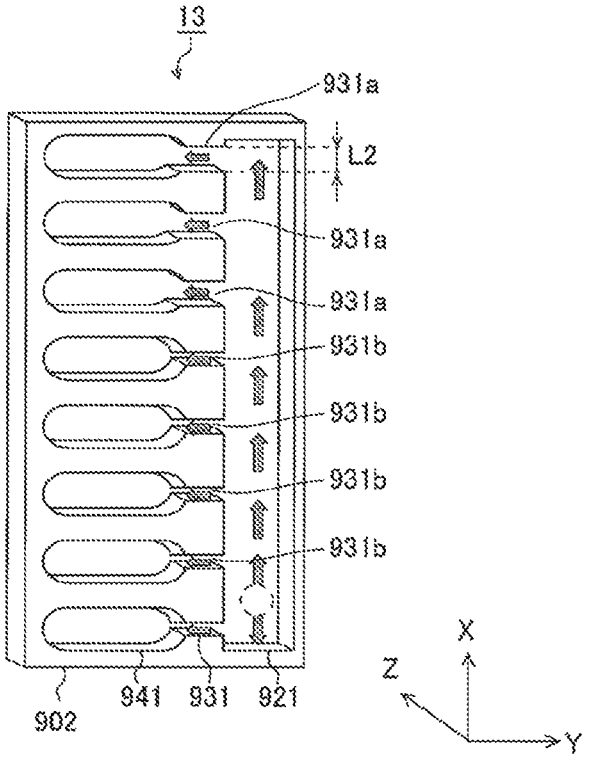
FIG. 8 is a perspective view of a second plate 902 of a distributor 13 according to Embodiment 3.

FIG. 8 is a perspective view of the second plate 902 of the distributor 13 according to Embodiment 3.

The second dimensions L2 in the X-axis direction, or the widths, of the second hollow portions 931 of the second plate 902 are gradually increased such that, for example, as the position of the second hollow portion 931 is closer to the downstream end of the first hollow portion 921 in the refrigerant flow direction, the second dimension L2 of the second hollow portion 931 is larger.

In other words, the flow rates of the refrigerant through the second hollow portions 931 gradually increase such that as the position of the second hollow portion 931 is closer to the downstream end of the first hollow portion 921 in the refrigerant flow direction, the flow rate of the refrigerant through the second hollow portion 931 is higher.

The second dimension L2 in the X-axis direction, or the width, of each of the second hollow portions 931 can be appropriately set based on the amount of refrigerant to be distributed. For example, FIG. 8 illustrates the second hollow portions 931 including three downstream second hollow portions 931*a* located downstream in the refrigerant flow direction and five upstream second hollow portions 931*b* located upstream in the refrigerant flow direction. The second dimension L2 in the X-axis direction, or the width, of each of the three downstream second hollow portions 931*a* may be set larger than that of each of the five upstream second hollow portions 931*b*. This arrangement allows the flow rate of the refrigerant through each of the downstream second hollow portions 931*a* to be higher than that through each of the upstream second hollow portions 931*b*.

<Advantageous Effects>

Such shapes of the second hollow portions 931 enable refrigerant distribution based on an uneven flow rate distribution of air supplied to the heat exchanger 100. For example, the heat transfer tubes 8 arranged in a section where the air flow rate is high are connected to correspond to the second hollow portions 931 each having a relatively increased second dimension L2, or width, in the X-axis direction. As described above, changing the second dimensions L2 in the X-axis direction, or the widths, of the second hollow portions 931 can adjust the amounts of refrigerant to be distributed to the heat transfer tubes, thus maximizing the performance of the heat exchanger 100.

Embodiment 4

A distributor 14 according to Embodiment 4 will be described.

In Embodiment 4, the elements common to Embodiment 1 are designated by the same reference signs and a description of these elements is omitted. The following description will focus on the difference between Embodiment 4 and Embodiment 1.

The distributor 14 according to Embodiment 4 is used in the refrigeration cycle apparatus and the heat exchanger 100, which are the same as those in Embodiment 1.

The distributor 14 according to Embodiment 4 differs from the distributor 10 according to Embodiment 1 in the shape of the second plate 902.

<Configuration of Distributor>

Figure 9:
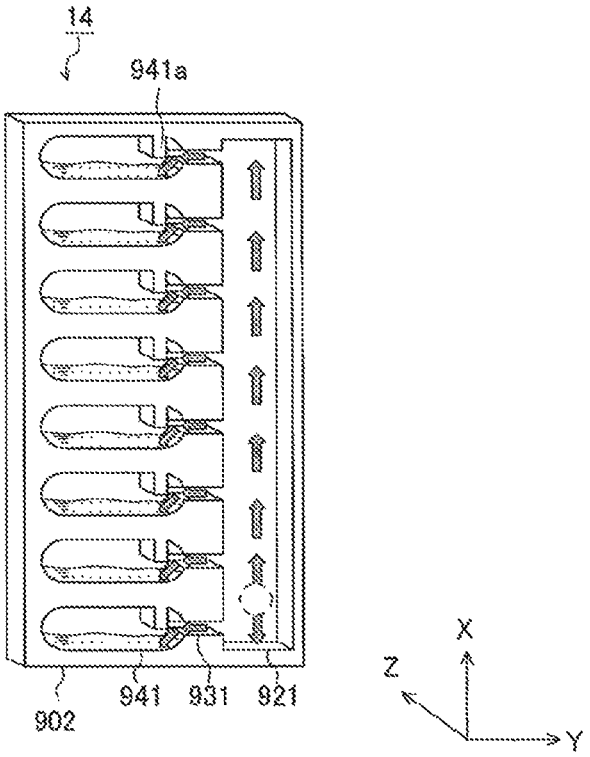
FIG. 9 is a perspective view of a second plate 902 of a distributor 14 according to Embodiment 4.

FIG. 9 is a perspective view of the second plate 902 of the distributor 14 according to Embodiment 4.

The second plate 902 in Embodiment 4 includes a protrusion 941*a* protruding vertically downward in each of the third hollow portions 941. The protrusion 941*a* of each third hollow portion 941 can cause the refrigerant leaving the corresponding one of the second hollow portions 931 to hit the bottom of the third hollow portion 941.

<Advantageous Effects>

The protrusions 941*a* in Embodiment 4 cause the lubricating oil, which tends to accumulate on the bottoms of the third hollow portions 941, to move upward along with the refrigerant. The lubricating oil moving upward in the above-described manner accompanies the flow of the refrigerant to the heat transfer tubes 8, so that the lubricating oil can hardly accumulate in the third hollow portions 941. In such a configuration, the protrusion 941*a* in each of the third hollow portions 941 is located closer to the corresponding one of the second hollow portions 931 than the middle of the third hollow portion 941 in its longitudinal direction, or the Y-axis direction. This arrangement allows agitation of the refrigerant, thus efficiently increasing the lubricating oil moving upward along with the refrigerant.

As described above, the distributor 14 according to Embodiment 4 includes the protrusions 941*a* located in the third hollow portions 941 of the second plate 902. This configuration allows efficient discharge of the lubricating oil, which tends to accumulate in the third hollow portions 941. This reduces or eliminates the likelihood that the lubricating oil in the compressor may be exhausted to cause a failure, and also reduces or eliminates an increase in cost of supplying an excess of lubricating oil to the refrigeration cycle apparatus.

REFERENCE SIGNS LIST compressor 2 four-way valve 3 indoor heat exchanger 4 expansion valve 5 outdoor heat exchanger 6 outdoor fan 7 indoor fan 8 heat transfer tube 10 distributor 11 distributor 12 distributor 13 distributor 14 distributor 15*a* primary heat exchange section 15*b* primary heat exchange section 16*a* secondary heat exchange section 16*b* secondary heat exchange section 100 heat exchanger 100*a* upstream heat exchanger element 100*b* downstream heat exchanger element 101 inlet pipe 201 secondary heat exchange distributor 301 secondary heat exchange distributor 401 primary heat exchange distributor 501 primary heat exchange distributor 601 connecting pipe 701 outlet pipe 801 connecting header 901 first plate 902 second plate 903 third plate 911 first through hole 921 first hollow portion 922 protrusion 923 broadening part 924 parallel-sided part 931 second hollow portion 931*a* downstream second hollow portion 931*b* upstream second hollow portion 941 third hollow portion 941*a* protrusion 951 second through hole

The invention claimed is:

1. A distributor comprising:

a first plate, a second plate, and a third plate, the first plate being stacked on the second plate in a stacking direction, the second plate being stacked on the third plate in the stacking direction, the first plate having a first through hole, the second plate having a first hollow portion communicating with the first through hole, a plurality of second hollow portions communicating with the first hollow portion, and a plurality of third hollow portions each communicating with its associated one of the plurality of second hollow portions, the third plate having a plurality of second through holes each communicating with its associated one of the plurality of third hollow portions, the first hollow portion having an elongate shape having a length along which a fluid flows and a width orthogonal to the length in a plane perpendicular to the stacking direction, the plurality of second hollow portions each having an elongate shape having a length along which the fluid flows and a width orthogonal to the length in the plane perpendicular to the stacking direction, wherein the plurality of second through holes each have an elongate shape having a length and a width orthogonal to the length in the plane perpendicular to the stacking direction, wherein L1 is larger than L2 where

L1 is a first dimension that is the width of the first hollow portion, and

L2 is a second dimension that is the width of each of the plurality of second hollow portions, and wherein L5 is larger than L6 where

L5 is a fifth dimension that is the length of each of the plurality of second through holes, and L6 is a sixth dimension that is a length of each of the plurality of third hollow portions.

2. The distributor of claim 1, wherein the plurality of third hollow portions each have an elongate shape having a length along which the fluid flows and a width orthogonal to the length in the plane perpendicular to the stacking direction, and wherein L3 is larger than L2 and is smaller than L1 where L3 is a third dimension that is the width of each of the plurality of third hollow portions.

3. The distributor of claim 1, wherein L4 is smaller than L3 where

L3 is a third dimension that is a width of each of the plurality of third hollow portions, and L4 is a fourth dimension that is the width of each of the plurality of second through holes.

4. The distributor of claim 1, wherein the first hollow portion includes a protrusion that partly reduces the first dimension L1 in a direction along the length of the first hollow portion.

5. The distributor of claim 1, wherein the first hollow portion includes a broadening part in which the first dimension L1 gradually increases in a direction along the length of the first hollow portion.

6. The distributor of claim 1, wherein the second dimensions L2 of the plurality of second hollow portions are two or more different dimensions.

7. The distributor of claim 6, wherein the second dimensions L2 of the plurality of second hollow portions are gradually increased in a direction along the length of the first hollow portion.

8. The distributor of claim 1, wherein the plurality of third hollow portions each include a protrusion protruding vertically downward.

9. The distributor of claim 8, wherein the protrusion of each of the plurality of third hollow portions is located closer to its associated one of the plurality of second hollow portions than a middle of the third hollow portion in a direction along the length of the third hollow portion.

10. A heat exchanger comprising the distributor of claim 1.

11. The distributor of claim 1, wherein

L4 is larger than L3 where

L3 is a third dimension that is a width of each of the plurality of third hollow portions, and L4 is a fourth dimension that is the width of each of the plurality of second through holes.

* * * * *